US010168053B2

(12) United States Patent
Kim

(10) Patent No.: US 10,168,053 B2
(45) Date of Patent: Jan. 1, 2019

(54) COMBUSTION APPARATUS FOR BOTH FIREWOOD AND PELLET FUEL

(71) Applicant: Seong Woo Kim, Gyeonggi-do (KR)

(72) Inventor: Seong Woo Kim, Gyeonggi-do (KR)

( * ) Notice: Subject to any disclaimer, the term of this patent is extended or adjusted under 35 U.S.C. 154(b) by 68 days.

(21) Appl. No.: 15/319,377

(22) PCT Filed: Jun. 2, 2015

(86) PCT No.: PCT/KR2015/005533

§ 371 (c)(1),
(2) Date: Dec. 16, 2016

(87) PCT Pub. No.: WO2015/199343

PCT Pub. Date: Dec. 30, 2015

(65) Prior Publication Data

US 2017/0138601 A1 May 18, 2017

(30) Foreign Application Priority Data

Jun. 24, 2014 (KR) ..... 10-2014-0077541

(51) Int. Cl.

| | |
|---|---|
| ***F24B 5/00*** | (2006.01) |
| ***F24B 1/02*** | (2006.01) |
| ***F23L 1/00*** | (2006.01) |
| ***F23B 60/00*** | (2006.01) |

(52) U.S. Cl.

CPC ..... *F24B 5/00* (2013.01); *F23B 60/00* (2013.01); *F23L 1/00* (2013.01); *F24B 1/028* (2013.01)

(58) Field of Classification Search

CPC ..... F24B 5/00; F24B 1/028
USPC ..... 110/251, 270, 288, 300, 297, 348; 126/501, 549, 68, 73, 502, 77, 163 R
See application file for complete search history.

(56) References Cited

U.S. PATENT DOCUMENTS 5,931,155 A * 8/1999 Hagner ..... F24B 1/19 126/307 R
8,528,540 B2 * 9/2013 Marple ..... F24C 3/002 110/298

FOREIGN PATENT DOCUMENTS

| | | | |
|---|---|---|---|
| JP | 09-004814 | A | 1/1997 |
| KR | 20-0452982 | Y1 | 3/2011 |
| KR | 10-2011-0042763 | A | 4/2011 |
| KR | 10-2012-0129025 | A | 11/2012 |
| KR | 10-1306160 | B1 | 9/2013 |
| KR | 10-2015-0024623 | A | 3/2015 |

OTHER PUBLICATIONS

International Search Report for PCT/KR2015/005533 dated Jul. 13, 2015 from Korean Intellectual Property Office.

* cited by examiner

*Primary Examiner* — Avinash Savani
*Assistant Examiner* — Rabeeul Zuberi
(74) *Attorney, Agent, or Firm* — Revolution IP, PLLC

(57) ABSTRACT

Disclosed is a combustion apparatus for both firewood and pellet fuel comprising: a combustion chamber in which wood fuel including firewood or a pellet is stacked; an air supply unit provided with an air supply pipe and a gap-maintaining member and including a nozzle connected to the air supply pipe and configured to spray air toward the wood fuel in a side direction thereof; and an operating unit configured to force the gap-maintaining member to come into contact with one side of the wood fuel to continuously maintain a constant gap between the nozzle and the wood fuel during combustion.

4 Claims, 6 Drawing Sheets

[20;21~26]

[20:21~26]

COMBUSTION APPARATUS FOR BOTH FIREWOOD AND PELLET FUEL

CROSS REFERENCE TO PRIOR APPLICATIONS

This application is a National Stage Application of PCT International Patent Application No. PCT/KR2015/005533 filed on Jun. 2, 2015, under 35 U.S.C. § 371, which claims priority to Korean Patent Application No. 10-2014-0077541 filed on Jun. 24, 2014, which are all hereby incorporated by reference in their entirety.

TECHNICAL FIELD

The present invention relates to a combustion apparatus for both firewood and pellet fuel, and more particularly, to a combustion apparatus for both firewood and pellet fuel including a gap-maintaining member provided at a nozzle configured to spray combustion air toward wood fuel in a side direction thereof, and an operating unit configured to force the gap-maintaining member to come into contact with one side surface of the wood fuel and to continuously maintain a constant gap between the nozzle and the wood fuel during burning combustion such that firewood and a pellet are selectively used as the wood fuel according to necessity so as to simultaneously achieve high thermal output performance, which is an advantage of a firewood combustion apparatus, and stable thermal output performance, which is an advantage of a pellet combustion apparatus, in a combustion apparatus using wood fuel used in a stove, a boiler, a fan heater, and the like.

BACKGROUND ART

Since leisure time is increased by extension of the five-day workweek and people are increasingly interested in escaping from a city, spending leisure time in a natural space, and enjoying camping in the outdoors, various camping products are being released.

In addition, it is important to solve a heating problem in order to enjoy camping regardless of season, and accordingly, products, such as a stove and the like, including a combustion apparatus having various combustion methods are being released.

Among such combustion apparatuses, products employing a combustion apparatus utilizing electricity are convenient to use but since electrical power is not sufficiently supplied at most camping areas, the use of such combustion apparatuses is highly limited.

In addition, products employing combustion apparatuses utilizing gas or petroleum are convenient to use, but gas or petroleum is difficult to easily obtain from surroundings thereof, and such fuel needs to be handled with a lot care. Particularly, in order to be suitably used for camping, such products have to be miniaturized to be conveniently carried, and since flues for discharging carbon monoxide, carbon dioxide, and the like are difficult to implement in such products, there is an inconvenience in that ventilation has to be periodically performed when using them.

Accordingly, various products employing combustion apparatuses utilizing wood fuel, which adds atmosphere of camping and is easy to handle and supply, are being released.

A firewood fuel (wood) combustion apparatus is a typical combustion apparatus utilizing wood fuel.

A prior art related to a firewood fuel combustion apparatus is disclosed in Korean Registered Utility Model No. 20-0452982 (Mar. 22, 2011) "Firewood Stove," and a firewood stove in the registered utility model includes a body forming a combustion chamber and having a central axis disposed in parallel to the ground, a cap and legs hinge-coupled to the body, an ashtray configured to slide in and out of the body, and a stovepipe mounting hole installed in an upper end of the body.

Since firewood, which is used in the firewood combustion apparatus disclosed in the registered utility model, is easy to burn, a structure of a combustion chamber that discharges combustion gas through a flue is simple and easy to design, thermal output (an amount of heat) generated during combustion is high, and firewood is easy to obtain from surroundings thereof, but since a combustion time of firewood is relatively short, there is a demerit in that firewood fuel has to be frequently input to the combustion apparatus.

In addition, while an importance of utilizing forest bio mass has emerged to address rising oil prices and reduce greenhouse gas, a wood pellet fuel combustion apparatus exists as a different combustion apparatus utilizing wood fuel.

A prior art related to the pellet fuel combustion apparatus is disclosed in Korean Patent Registration No. 10-1306160 (Sep. 3, 2013) "Method of Burning Wood Pellet and Burner," and the burner in the registered patent is formed in such a way that ceramic particles are laid on a perforated grille to form a grate, wood pellets are sprayed on the perforated grille while combustion air is sprayed from a lower side of the perforated grille, the ceramic particles and the wood pellets on the grate are stirred by a stirring part when ash generated by combustion is discharged to a second combustion space positioned along a lower stream by a stream of the combustion air or gas, and a clinker of a combusted material generated on the grate is broken.

In the pellet fuel combustion apparatus disclosed in the registered patent, since it is easy to discharge combustion gas through a flue similar to a firewood fuel combustion apparatus and combustion fuel is maintained for a long time and heat is stably output when fuel including a plurality of pellets is input one time, the pellet fuel combustion apparatus is convenient to use. However, since fuel to be input is limited to pellet fuel, there are demerits in that since the fuel is difficult to supply from surroundings thereof, the pellet fuel has to be additionally prepared by being purchased for camping.

Accordingly, products that employ a combustion apparatus capable of using both firewood and pellet fuel, and which normally use and combust firewood when a user is active and use and combust pellets when the user is asleep so that a certain thermal power is maintained for a long time, simultaneously realize both strong thermal output and stable thermal output performance for a long time, and so have recently been in the spotlight.

However, such a firewood and pellet combustion apparatus is manufactured in a form in which a pellet combustion chamber is additionally installed in a combustion chamber rather than in a form in which both firewood and a pellet are burned in a common combustion chamber.

That is, since a firewood and pellet combustion apparatus that is currently commercially available is manufactured in a form in which a firewood combustion apparatus and a pellet combustion apparatus are simply coupled to each other instead of in a form of a single combustion apparatus so that using the firewood and pellet combustion apparatus is the same as using two combustion apparatuses, a cost burden for purchasing the firewood and pellet combustion apparatus is high according to an increase in a manufacturing cost of the product, and since a volume of a product employing the firewood and pellet combustion apparatus increases and portability thereof decreases, there is a limitation in that the product employing the firewood and pellet combustion apparatus is not suitable for camping use and the like.

Such a limitation is attributable to difference in combustion environments of firewood and pellet fuel.

More specifically, since air easily circulates for burning firewood, firewood may be burned regardless of a form of a combustion chamber. That is, since air easily circulates between pieces of firewood due to forms of the pieces of firewood, the pieces of firewood are burned as long as air is supplied to the combustion chamber in any direction, and since the forms of the pieces of firewood are not greatly changed even when the pieces of firewood are burned and become charcoal and ash, an air flow is smoothly maintained so that combustion is smoothly performed without being hindered by a direction of a supply of air.

Conversely, since pellets are small and cylindrical and have a constant size and shape and very small gaps are formed between the fuel pellets in a state in which fuel including a plurality of pellets is stored in the combustion chamber, outside air cannot easily reach a pellet fuel thereinside, and since air has to be supplied to the pellet fuel by being quickly supplied to surfaces of pellets which are being combusted, there is a limitation on the direction or position of the supply of air.

Accordingly, since a combustion region of a conventional pellet fuel combustion apparatus is concentrated on a combustion mesh (a crucible) or the like and stable combustion is performed by intensively supplying air to the combustion region while the combustion mesh is maintained at a high temperature, a structure and a form of the combustion chamber should be limited.

That is, in the case of the pellet fuel, stable burning similar to a case of firewood fuel being simply stacked is not secured, and accordingly, since a combustion chamber having a specific structure is required in addition to a combustion chamber for firewood, it is impossible to use both firewood and a pellet at the same time, and since the conventional combustion apparatus for both firewood and pellet fuel has to be manufactured to have a form in which two combustion apparatuses are only simply coupled due to the above-described problems, it is impossible to manufacture a combustion apparatus for both firewood and pellet fuel using a single combustion chamber, and since effects of easing manufacturing and reducing a manufacturing cost are difficult to expect, there is a problem in that a cost burden of a user for purchasing the combustion apparatus is increased.

DISCLOSURE

Technical Problem

The present invention is directed to providing a combustion apparatus for both firewood and pellet fuel, which is practically integrated differently from a conventional combustion apparatus for both firewood and pellet fuel so that effects of easing manufacturing and reducing manufacturing costs by burning wood and a pellet using only a single combustion chamber may be expected, in which a nozzle provided in an air supply pipe sprays air toward wood fuel in a side direction thereof to stably burn both of firewood and pellet fuel by stably and intensively supplying air to a region in which combustion is performed in a state in which the pellet fuel, in which spaces for air circulation are difficult to secure unlike firewood, is simply stacked, and by enabling by-products, such as ash, generated after combustion to fall naturally so that they do not interfere with a supply of air.

Particularly, the present invention is also directed to providing a combustion apparatus for both firewood and pellet fuel configured to maintain a constant gap between the nozzle, through which air is supplied, and wood fuel to stably supply air to the wood fuel by an operating unit forcing a gap-maintaining member to constantly be brought into contact with one side surface of the wood fuel.

Furthermore, the present invention is also directed to providing a combustion apparatus for both firewood and pellet fuel which includes an operating unit having an air supply pipe, which operates according to swing or towing in a combustion chamber, to be used outdoors, such as at a camping area at which power is not sufficiently supplied, to stably maintain combustion efficiency for a long time by precisely controlling a spray angle and a spray pressure of supplied air.

Technical Solution

One aspect of the present invention provides a combustion apparatus for both firewood and pellet fuel including: a combustion chamber in which wood fuel including firewood or a pellet is stacked; an air supply unit provided with an air supply pipe and a gap-maintaining member, including a nozzle connected to the air supply pipe, and configured to spray air toward the wood fuel in a side direction thereof; and an operating unit configured to force the gap-maintaining member to come into contact with one side of the wood fuel to continuously maintain a constant gap between the nozzle and the wood fuel during combustion.

In addition, in the combustion apparatus for both firewood and pellet fuel, the air supply pipe may be installed to swing about a shaft coupling portion at an upper portion of the combustion chamber, the operating unit may be provided as a swing part provided at the shaft coupling portion and configured to force the nozzle provided at an end of the air supply pipe to swing toward the one side of the wood fuel, and the constant gap between the nozzle and the wood fuel may be maintained during combustion.

In addition, in the combustion apparatus for both firewood and pellet fuel, the air supply pipe may be formed as a telescopic type, the operating unit may be provided as a towing part configured to force the nozzle to be towed toward the one side of the wood fuel, and the constant gap between the nozzle and the wood fuel may be maintained during combustion.

Furthermore, in the combustion apparatus for both firewood and pellet fuel, the nozzle may include a plurality of air spray holes, and the gap-maintaining member may be provided with a plurality of protruding pieces protruding forward along perimeters of the air spray holes.

Advantageous Effects

Since the combustion apparatus for firewood and pellet fuel according to the present invention enables combustion of firewood and pellet fuel in a single combustion chamber, the combustion apparatus for both firewood and pellet fuel which actually uses both firewood and pellet is provided, and ease of manufacturing is achieved and manufacturing costs are reduced, a cost burden of a user for purchasing the combustion apparatus can be reduced and the combustion apparatus for both firewood and pellet fuel can be popularized.

Particularly, since the combustion apparatus for both firewood and pellet fuel according to the present invention can use pellet fuel, in which a space for air circulation is difficult to secure unlike firewood, by simply piling the pellet fuel using the same method as firewood, it is easy to maintain constant thermal power and a user can accordingly select firewood and pellet fuel according to necessity, and thus usage thereof is very convenient, and particularly, when the combustion apparatus for both firewood and pellet fuel according to the present invention is employed in a product used for a heater outdoors such as at a camping area and the like, since a user can use firewood to adjust thermal power as necessary when the user is normally active and the user can use a pellet to maintain constant thermal power at night when the user sleeps, a hassle in that fuel is frequently input is reduced, and thus usage thereof is very convenient, and since the combustion apparatus for both firewood and pellet fuel uses pellet fuel only at night, an amount of use of the pellet fuel can be decreased, and since it is easy to prepare or obtain firewood and the pellet fuel, the present invention has very excellent versatility and usefulness.

In addition, since the combustion apparatus for both firewood and pellet fuel according to the present invention has a nozzle which supplies air and a constant gap between the nozzle and wood fuel is continuously maintained by an operating unit, it is very easy to increase a combustion efficiency and to adjust thermal power by stably supplying air, and since the gap is maintained constantly while the nozzle is operated by swing or towing of an air supply pipe, both firewood and pellet fuel can be used by being combusted even at an area such as a camping area in which power is not sufficiently supplied, the combustion apparatus according to the present invention is suitably employed in products used for an outdoor activity.

Furthermore, since a position of the nozzle of the combustion apparatus for both firewood and pellet fuel according to the present invention is changed by the operating unit and a gap-maintaining member, a spraying angle and a pressure of sprayed air can be controlled to be constantly maintained, and thus the combustion apparatus is very advantageous in that a combustion environment for wood fuel is stably maintained.

Figure 1:
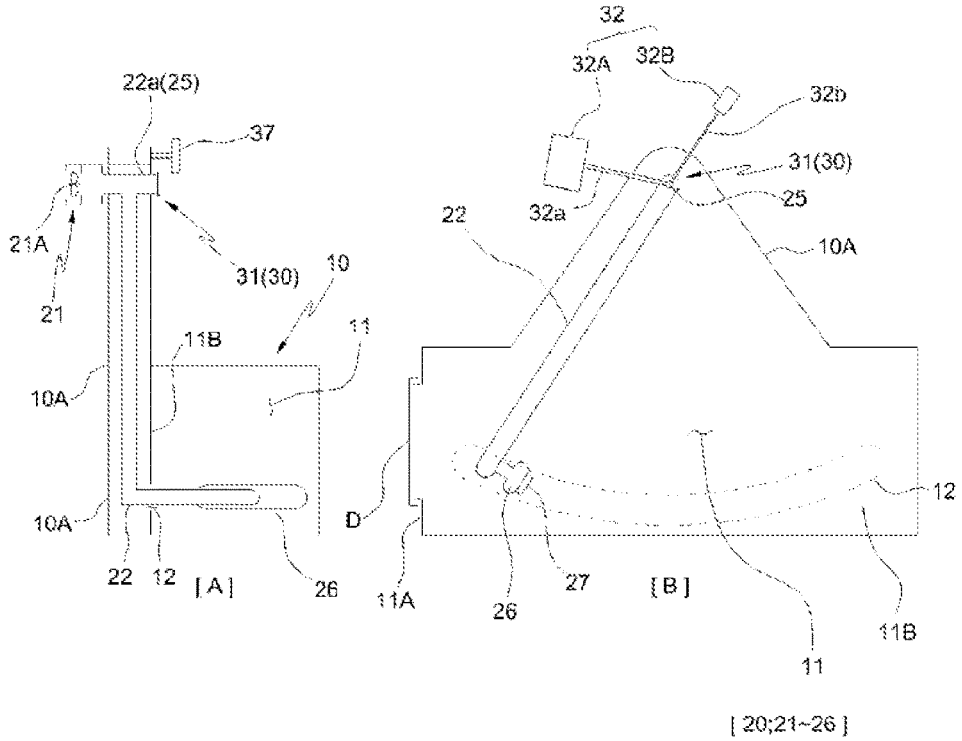
FIGS. 1 to 3 are schematic views illustrating a combustion apparatus according to a first embodiment of the present invention.

| [Reference Numerals] | |
|---|---|
| W: WOOD FUEL | F: FIREWOOD FUEL |
| P: PELLET FUEL | |
| 10: HOUSING | 11: COMBUSTION CHAMBER |
| 12: OPENING | 14: MOVING IN AND OUT PORT |
| 20: AIR SUPPLY UNIT | 21: AIR SUPPLY PART |

-continued

| [Reference Numerals] | |
|---|---|
| 22, 22A: AIR SUPPLY PIPE | 24: HEAD |
| 25: SHAFT COUPLING PORTION | 26: NOZZLE |
| 27: GAP-MAINTAINING MEMBER | 27A: PROTRUDING PIECE |
| 28: WHEEL | |
| 30: OPERATING UNIT | 31: SWING PART |
| 32: SWING WEIGHT | 33: TOWING PART |
| 34: WIRE | 35A, 35B: ROLLER |
| 36: WEIGHT | |

MODES OF THE INVENTION

While the invention may be modified in various ways and take on various alternative forms, specific embodiments thereof are shown in the drawings and described in detail below as examples. However, there is no intent to limit the invention to the particular forms disclosed. On the contrary, the invention covers all modifications, equivalents, and alternatives falling within the spirit and scope of the appended claims.

In the drawings, the same reference numerals, particularly, the numbers at the tens place and units place, or the same reference numerals of the tens place, the units place, and letters are used to designate the same or similar elements, and members denoted by the same or similar reference numerals in the drawings should be understood as the same or similar members based on such a criterion unless specifically described otherwise.

In addition, components in the drawings are illustrated in such a way that sizes and thicknesses are exaggerated to be big (or thick) or small (or thin), or are simply illustrated in consideration of convenience of understanding or the like, but the scope of the present invention is not limited thereto.

The terminology used herein is for the purpose of describing particular aspects (or embodiments) only and is not intended to be limiting to the invention. As used herein, the singular forms "a," and "an" are intended to include the plural forms as well unless clearly indicated otherwise by context.

It should be further understood that the terms "comprise," "comprising," "include," and/or "including" specify the presence of stated features, integers, steps, operations, elements, and/or components when used in this specification, but do not preclude the presence or addition of one or more other features, integers, steps, operations, elements, and/or components.

Unless otherwise defined, all terms (including technical and scientific terms) used herein are to be interpreted as is customary in the art to which this invention belongs. It should be further understood that terms in common usage should also be interpreted as is customary in the relevant art and not in an idealized or overly formal sense unless expressly so defined herein.

In this specification, the terms first, second, etc. are used to distinguish one component from another, but these components are not influenced by a manufacturing order and the names in the detailed description and the claims may not match.

In the description of a combustion apparatus for both firewood and pellet fuel according to the present invention, when approximate directions are specified with reference to FIGS. 1B and 4B, up, down, left, and right directions are specified with respect to a direction seen from the front of the combustion apparatus for the sake of convenience in the description. Directions in the Modes of the Invention and Claims related to the other drawings are described by being specified with reference to the above definition unless specifically described otherwise.

Hereinafter, a combustion apparatus for both firewood and pellet fuel according to the present invention will be described with reference to the accompanying drawings.

First, as illustrated in FIGS. 1 to 6, the combustion apparatus according to an embodiment of the present invention mainly includes a housing 10 having a combustion chamber 11 in which wood fuel W is stacked, an air supply unit 20 installed in the housing 10 and configured to supply air toward wood fuel, and an operating unit 30 configured to maintain a constant gap between a nozzle 26 of the air supply unit 20 and the wood fuel W.

In the present invention, the concept of the combustion apparatus includes an apparatus that can be utilized as a combustion device in all of an apparatus, such as a stove, a boiler, and a fan heater, that uses thermal power by burning fuel, an apparatus used as a stove and the like in a narrow sense when only the combustion apparatus of the present invention is independently used, and an apparatus used as a boiler, a fan heater, and the like in a wide sense when the combustion apparatus and a heat exchanger (a hot water supply part which heats water or a hot-air supplier which heats air using thermal power) are coupled, and while the specification describes a typical concept of a stove in which a combustion apparatus is independently used, the scope of the present invention is not limited thereto.

The wood fuel W is used as fuel used in the combustion apparatus of the present invention, and both firewood fuel F (see FIG. 3), such as firewood and the like, manufactured (or obtained) to have a predetermined size or more, and pellet fuel P (see FIG. 4) manufactured to have a small size and a predetermined specification and shape may be used as the wood fuel W.

The housing 10 has a predetermined length in a horizontal direction and a box form with a cross section perpendicular to the horizontal direction in a rectangular, polygonal, circular, semicircular, or oval shape, is surrounded by panels, and includes a combustion chamber 11 therein, a door installed at one side panel thereof through which the wood fuel W is input, and the combustion chamber 11 may further include a base plate (not shown) with which by-products, such as charcoal and ash, generated after combustion, may be removed.

In addition, the combustion chamber 11 may include a flue (not shown) connected to the outside at an upper panel thereof to discharge a combustion gas generated during combustion. An outside of a bottom panel may be provided with legs (not shown) and the like configured to support the housing 10, and the upper panel may also have a structure which is independently opened to input the wood fuel W or to clean the combustion chamber 11, The housing 10 is manufactured to have the horizontal combustion chamber 11 having a predetermined length in a lateral (horizontal) direction, a combustion region B (a region in which combustion is practically performed) is formed at one side of the wood fuel W in a state in which the wood fuel W, particularly the pellet fuel P, is stacked therein, the air supply nozzle 26 is disposed to be adjacent to the combustion region B to intensively spray air toward the wood fuel W in a side direction thereof.

The drawings of the present invention, a door D is typically illustrated to be installed at a left panel 11A of the horizontal combustion chamber 11, the nozzle 26 is typically illustrated to be disposed on the left of the combustion chamber 11, air is supplied while a position of the nozzle 26 is changed from the left to the right by the operating unit 30, and the explanation will be describe on the basis thereof while other parts which may be further added to the combustion apparatus are omitted for the sake of convenience in the description. Accordingly, other parts additionally included in a combustion apparatus employed for various kinds of products may sufficiently be predicted and reproduced by general engineers in the relevant field of technology including the present invention (hereinafter, referred to as those skilled in the art), and such additional parts will not be described because of little association with the essential gist of the present invention.

In the horizontal combustion chamber 11 according to the embodiment of the present invention, the combustion region B is formed at one side of the wood fuel W and the nozzle 26 is disposed in the combustion region B, and since a constant gap between the wood fuel W and the nozzle 26 is maintained, a combustion environment suitable for combustion is constantly provided. This is because it is not especially difficult to provide a combustion environment in which combustion is performed even when the combustion region B is formed in any direction in the case of the firewood fuel F, however, in the horizontal combustion chamber 11 according to the embodiment of the present invention, in the case of the pellet fuel P, when the combustion region B is formed on the pellet fuel P in a state in which the pellet fuel P is stacked like the firewood fuel F, only the pellet fuel P placed at an upper portion (an outer portion) thereof is burned, and since ash and the like are stacked, air does not reach a lower portion (an inner portion) in the pellet fuel P, a supply of air thereto is blocked, and combustion is not performed.

That is, when the combustion region B is formed at one side of the pellet fuel P stacked to have a predetermined length in the horizontal combustion chamber 11 and air is supplied to the combustion region B in a side direction thereof, since the sprayed air is not wasted by being immediately discharged and passes through the combustion region B to reach an inside of the pellet fuel P, it is easy to maintain a predetermined thermal power or more, and since by-products remaining after combustion do not cover the combustion region B but are stacked on a bottom of the combustion chamber 11 due to a pressure of the supplied air and a weight of the by-products, an environment in which the pellet fuel P may be burned to have uniform thermal power for a long time can be provided.

Figure 2:
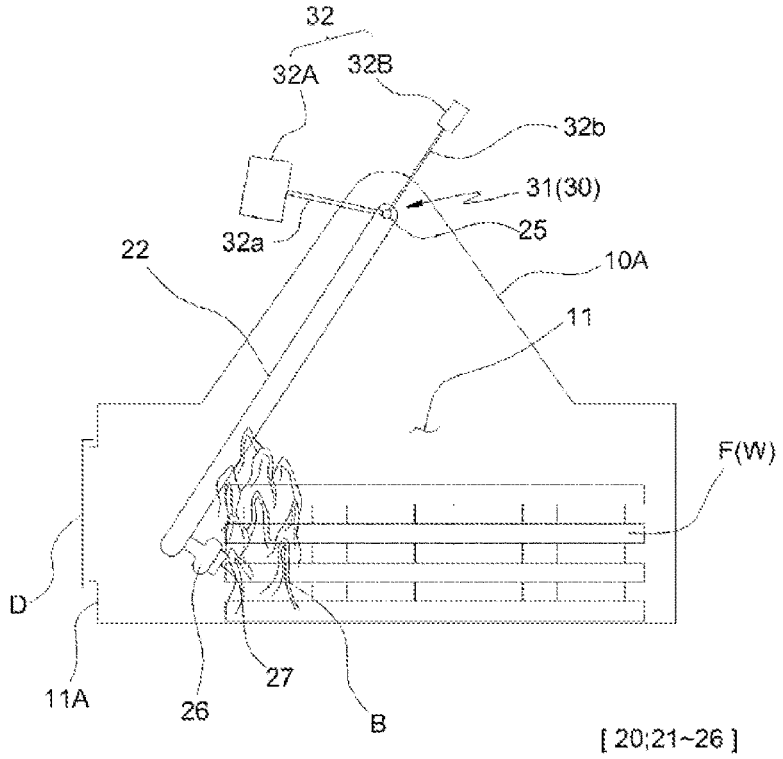
Figure 3:
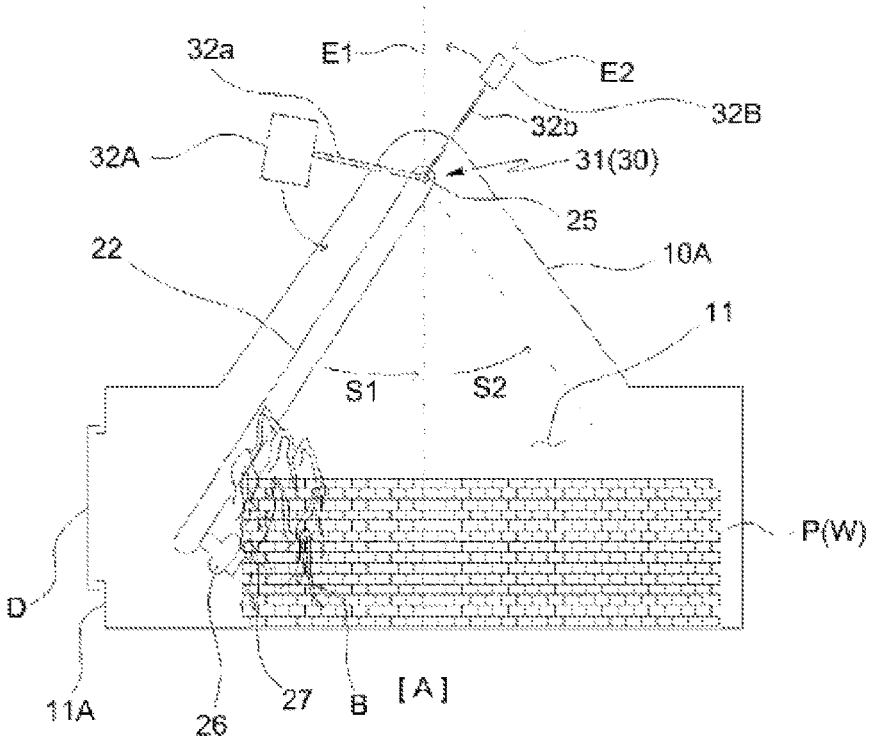
Figure 3:
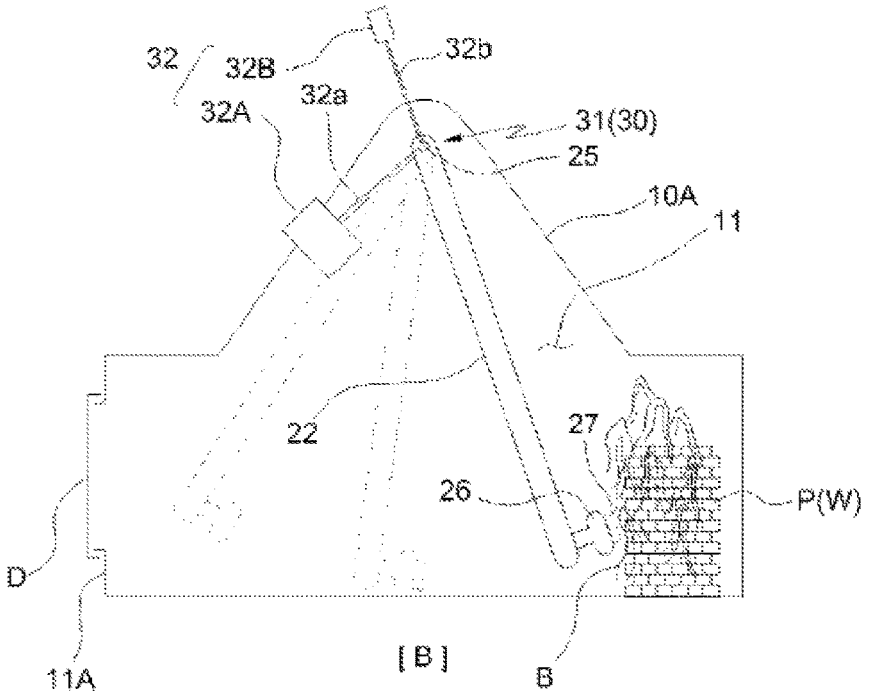

To this end, as illustrated in FIGS. 1 to 3, the combustion apparatus according to the embodiment of the present invention includes the air supply unit 20 having an air supply pipe 22 and the air spray nozzle 26 connected to the air supply pipe 22. Since the position of the nozzle 26 is changed by the operating unit 30 so that the constant gap between the nozzle 26 and the wood fuel W is continuously maintained while the nozzle 26 sprays air toward the wood fuel W (see FIGS. 2 and 3) stacked in the combustion chamber 11 in the side direction thereof (a left direction in the drawings) and the wood fuel W is burned, air is uniformly supplied regardless of a kind of the wood fuel W, that is, the firewood or pellet fuel F or P, stacked in the combustion chamber 11 so that a combustion environment can be constantly provided.

Here, it is very important to maintain the constant gap between the nozzle 26 and wood fuel W to constantly provide a combustion environment suitable for combustion regardless of the kind of the wood fuel W (particularly in the case of the pellet fuel P).

That is, since a space between pieces of firewood is sufficient in a case in which the firewood fuel F is stacked, there is no problem in combustion as long as the nozzle 26 sprays air at a predetermined pressure or speed or more, however, when a gap between pellets of the pellet fuel P is narrow in a case in which the pellet fuel P is stacked, the combustion region B is accordingly formed at the one side of the pellet fuel P, and the nozzle 26 is fixed to one side in the combustion chamber 11, since a gap between the nozzle 26 and the combustion region B of the pellet fuel P is increased as combustion progresses and air sprayed in the side direction thereof cannot easily reach the inside of the pellet fuel P due to resistance of a surface of the combustion region B, only some of the sprayed air is used for burning, most of the air is discharged to the outside, the combustion environment is not maintained, thermal power is reduced, and finally burning stops, and thus it is very important to maintain the constant gap between the nozzle 26 and the pellet fuel P.

Figure 7:
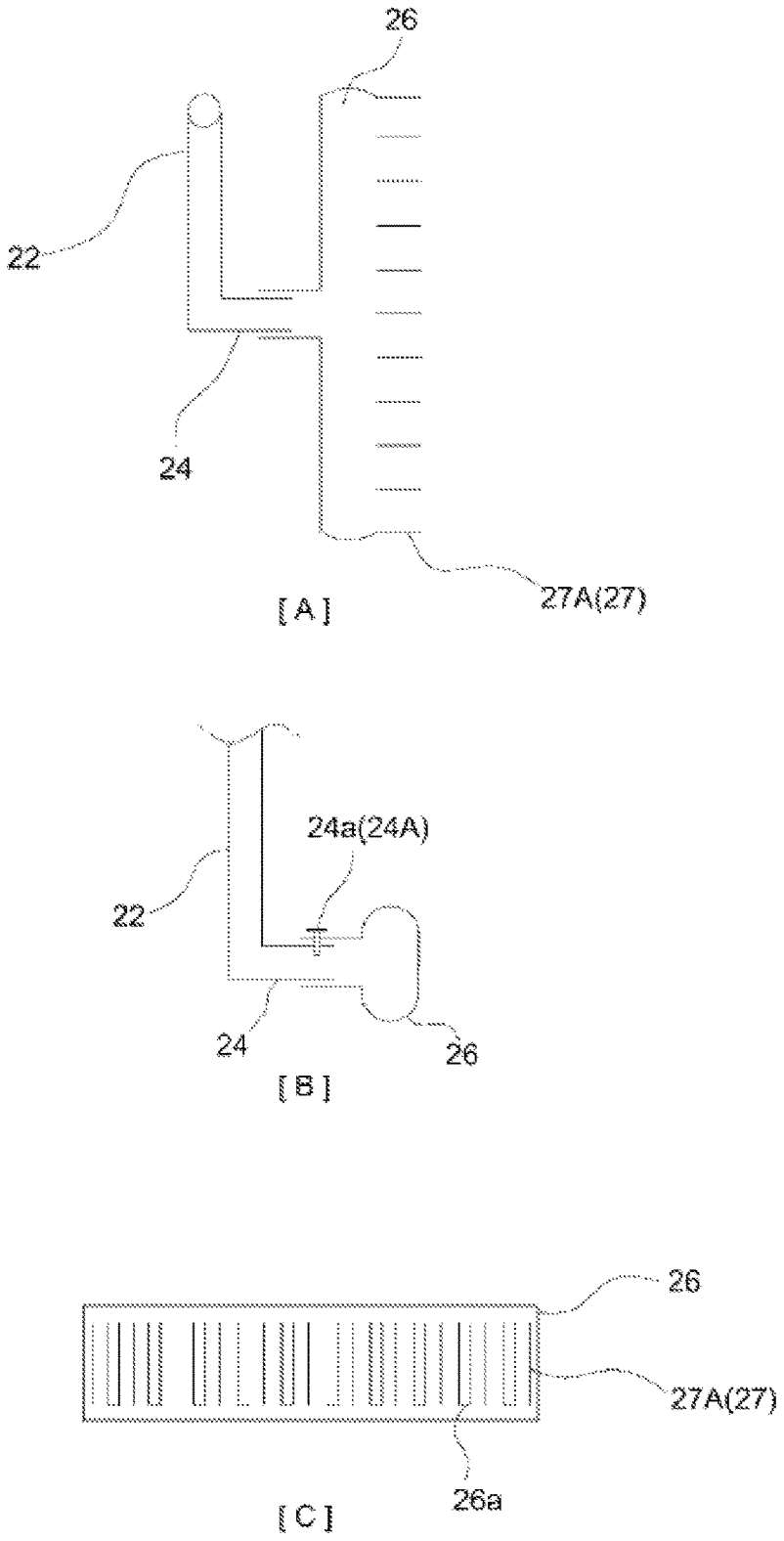
FIG. 7 is a schematic view illustrating a nozzle and an air supply pipe of a combustion apparatus according to an embodiment of the present invention.

Accordingly, as illustrated in FIG. 7, in the combustion apparatus according to the embodiment of the present invention, the nozzle 26 includes a gap-maintaining member 27, and the operating unit 30 forces the gap-maintaining member 27 to come into contact with one side of the wood fuel W so that the constant gap between the nozzle 26 and the wood fuel W is continuously maintained.

That is, when the combustion region B is formed at one side of the pellet fuel P (the left side in the drawings) in the case of the pellet fuel P, as combustion progresses from one side to the other side (toward the right side in the drawings), by-products, such as ash and the like, remaining after combustion naturally fall and are stacked on the bottom of the combustion chamber 11, and a position of the burning region B is changed to the other side, and here, when the gap-maintaining member 27 of the nozzle 26 is maintained by the operating unit 30 to be constantly in contact with one side of the pellet fuel P at which combustion is progressing, since the gap between the nozzle 26 and the pellet fuel P is maintained constantly, air is stably and smoothly supplied toward the inside thereof from the combustion region B like a combustion material of a cigarette, and since a combustion environment suitable for combustion is constantly provided even in the case of the pellet fuel P in which an air circulation space is difficult to secure when the pellet fuel P is stacked unlike the firewood fuel F, there are effects in that it is easy to stably maintain thermal power and a combustion efficiency is also improved.

Meanwhile, the operating unit 30 according to the embodiment of the present invention may be formed to operate in various manners. For example, when the operating unit 30 is formed in such a way that the position of the nozzle 26 is automatically changed by an electric motor or the like while the wood fuel W is being burned, since a separate sensor is employed or an operation of the electric motor has to be precisely controlled to maintain the constant gap between the nozzle 26 and the wood fuel W, a structure and a form thereof are complex, manufacturing is not easy, and thus manufacturing costs may be increased because a cost of an additional part to be used is high, and in consideration of one of the main purposes of the present invention in which the combustion apparatus for both firewood and pellet fuel may be manufactured with a low cost, a mechanical method other than the above-described electronic method is preferably employed as a method of maintaining a gap.

Then, a first embodiment of the operating unit 30 for achieving the above-described purposes is illustrated in FIGS. 1 to 3, and the air supply pipe 22 is installed to swing about a shaft coupling portion 25 at an upper portion of the combustion chamber 11, and the operating unit 30 is provided at the shaft coupling portion 25 and is provided as a swing part 31 configured to force the nozzle 26 provided at an end of the air supply pipe 22 to swing toward one side of the wood fuel W, and the constant gap between the nozzle 26 and the wood fuel W is maintained during combustion.

More specifically, an auxiliary housing 10A forming a space in which the air supply pipe 22 swings is provide at one side (the left side in the drawings) of the housing 10, and a bent portion 22*a* of the air supply pipe 22 is hinge-coupled to an upper portion of the auxiliary housing 10A to form the shaft coupling portion 25.

An air supply fan 21A which is an air supply part 21 and a damper (not shown) configured to adjust a supply of air are installed at an outer side of the bent portion 22*a* to supply air to the air supply pipe 22 and the nozzle 26 so that the air is sprayed.

In addition, an opening 12 in a long groove form corresponding to a swing trajectory of the air supply pipe 22 is provided at a back panel 11B to which the housing 10 and the auxiliary housing 10A are coupled, and the nozzle 26 is disposed in the opening 12 so that while the air supply pipe 22 is swung by the swing part 31 of the shaft coupling portion 25, the nozzle 26 is forced to swing toward the one side of the wood fuel W, and accordingly, when by-products in the combustion region B free-fall and a position of the combustion region B is changed while the wood fuel W is burning, the gap-maintaining member 27 comes into contact with the one side of the wood fuel W (the combustion region B) due to swinging of the air supply pipe 22 and the gap between the nozzle 26 and the wood fuel W is maintained constantly.

Here, although the swinging of the air supply pipe 22 may be controlled using an electric motor as the swing part 31, since employing the electric motor is not consistent with achieving the purpose of the present invention, the swing part 31 is preferably provide with one or more swing weights 32 installed at the shaft coupling portion 25 and configured to be rotated by a weight thereof and automatically swing the air supply pipe 22.

In addition, the swing weights 32 are preferably and detachably provided at the shaft coupling portion 25 and used by being replaced according to the kind of wood fuel W to maintain a constant pressure and a constant speed (a force for pushing the wood fuel W, hereinafter referred to as a torque) by which the nozzle 26 is swung.

This is to prevent incomplete combustion which occurs when the position of the nozzle 26 is not changed because the torque is too weak to push by-products of the firewood fuel F or the position of the nozzle 26 is excessively changed because the torque is strong enough to push the pellet fuel P before the pellet fuel P is burned by adjusting weights of the swing weights 32 and using the swing weight 32 because strength of by-products, such as ash and the like, generated in the combustion region B while the firewood fuel F burns is different from strength of by-products, such as ash and the like, generated in the combustion region B while the pellet fuel P burns, and the torque of the nozzle 26 is determined by the weights of the swing weights 32.

Particularly, as illustrated in FIG. 3, when the position of the nozzle 26 is changed by the swing weights 32, a torque thereof is increased in a section (a first section S1) in which the nozzle 26 swings downward due to the weights of the swing weights 32 and a weight of the nozzle 26 according to the burning of the wood fuel W, and an actual torque thereof is decreased in a section (a second section S2) in which the nozzle 26 swings upward because a weight, which rotates the swing weights 32, is decreased due to the weight of the nozzle 26, and the swing part 31 is provided with one or more first swing weights 32A, one or more second swing weights 32B lighter than the first swing weight 32A, a first swing rod 32*a* including an end provided with the first swing weight 32A and connected to the shaft coupling portion 25 to be spaced a predetermined angel upward from the air supply pipe 22, and a second swing rod 32*b* including an end provided with the second swing weight 32B and connected to the shaft coupling portion 25 to be symmetrical to the first swing rod 32*a* to maintain a constant torque of the nozzle 26 regardless the use of the firewood fuel F or the pellet fuel P.

Accordingly, in the first section S1, the torque is determined according to a change of potential energy of the first and second swing weights 32A and 32B in a state in which a swing torque of the nozzle 26 is decreased because a weight of the first swing weight 32A which rotates downward and a weight of the nozzle 26 which swings downward, which act as a swing torque of the nozzle 26, are decreased due to a weight of the second swing weight 32B which rotates upward, and in the second section S2, the torque is determined according to a change of the potential energy of the first and second swing weights 32A and 32B in a state in which the swing torque of the nozzle 26 is increased because the weight of the first swing weight 32A, which rotates downward and acts as the swing torque of the nozzle 26, is decreased due to the weight of the nozzle 26, which swings upward, but the weight is again increased due to the weight of the second swing weight 32B which rotates downward, and accordingly a constant torque is maintained regardless of the sections in which the nozzle 26 swings.

Meanwhile, when an angle between the first and second swing weights 32A and 32B, that is, a separate angle between the first and second swing rods 32*a* and 32*b*, is formed to be greater than a swing trajectory of the nozzle 26, a mutual adjustment action of a weight acting while the swing weights 32 rotate reversely acts and may disturb the swinging of the nozzle 26, and the angle at which the first swing rod 32*a* is formed preferably acts so that the weight of the first swing weight 32A does not decrease the torque of the nozzle 26 by restricting the first swing rod 32*a* not to pass a first extension line E1, which passes vertically through the shaft coupling portion 25, in a reverse direction of rotation of the first swing weight 32A when the air supply pipe 22 is positioned at a swing start position, and an angle at which the second swing rod 32*b* is formed preferably acts so that the weight of the second swing weight 32B increases the torque of the nozzle 26 at a position at which the nozzle 26 is vertical while swinging (while moving from the first section S1 to the second section S2 when a direction of the nozzle 26 is the same as a direction in which gravity acts) by forming the second swing rod 32*b* in the same direction as that of a second extension line E2 extending longitudinally from the air supply pipe 22.

That is, the weight of the first swing weight 32A is prevented from acting in a direction opposite a swing direction of the nozzle 26 when the air supply pipe 22 is positioned at the initial swing position and the first swing weight 32A is disposed beyond the first extension line E1 and rotates upward. In addition, the weight of second swing weight 32B is prevented from acting in a direction opposite a swing direction of the nozzle 26 when the air supply pipe 22 is positioned to be vertical while swinging and the second swing weight 32B is not disposed at the same position as that of the second extension line E2.

Meanwhile, since the torque of the nozzle 26 is determined according to the weights of the first and second swing weights 32A and 32B, the weight of the nozzle 26, the length of the air supply pipe 22, lengths and angles of the first and second swing rods 32*a* and 32*b*, and the like, the torque thereof may be adjusted in consideration of a strength of by-products after firewood and pellet fuel are burned and an entire swing angle of the air supply pipe 22 (that is, the nozzle 26), and since such adjustment may be sufficiently predicted and reproduced, a detailed description thereof will be omitted.

Figure 4:
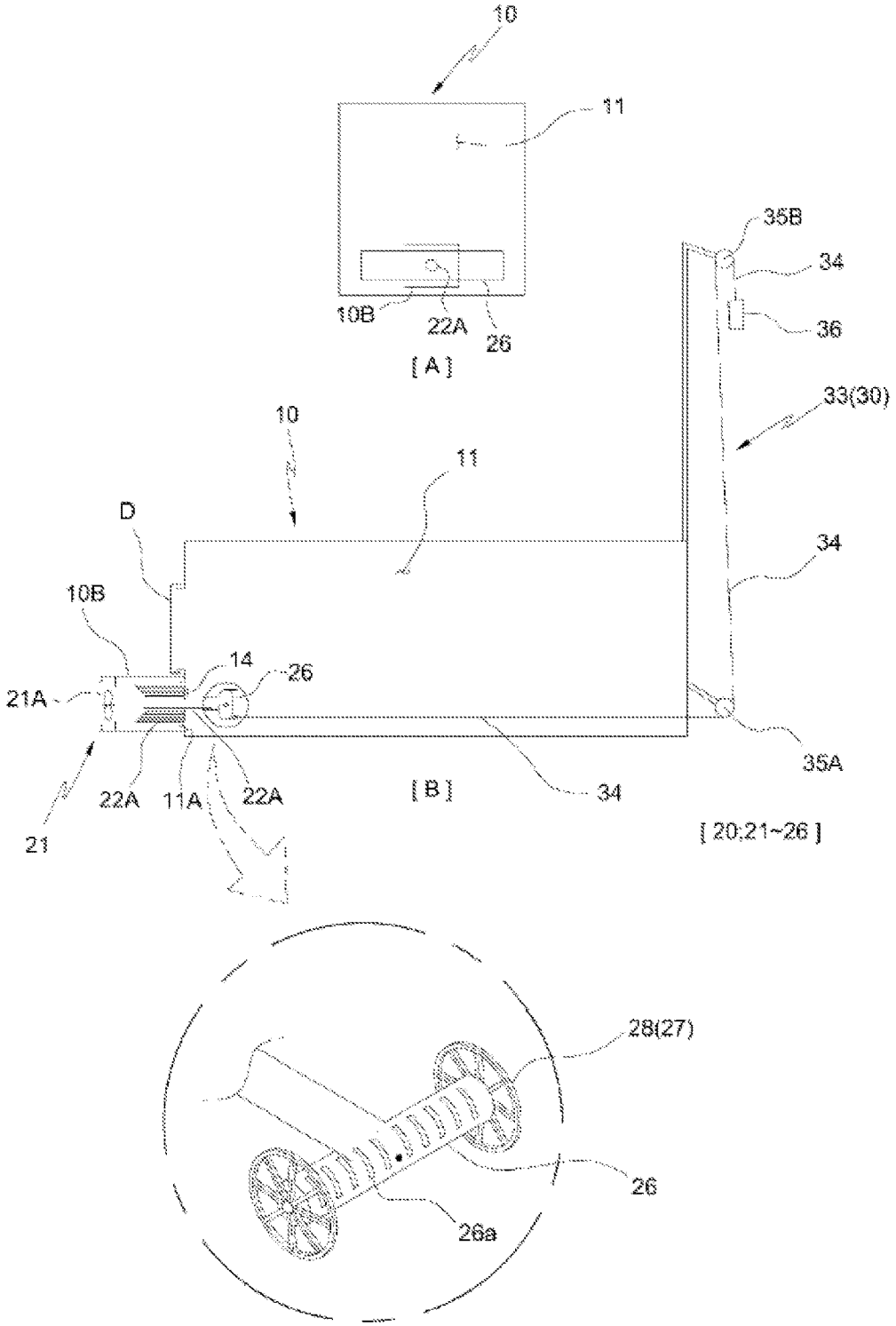
FIGS. 4 to 6 are schematic views illustrating a combustion apparatus according to a second embodiment of the present invention.
Figure 5:
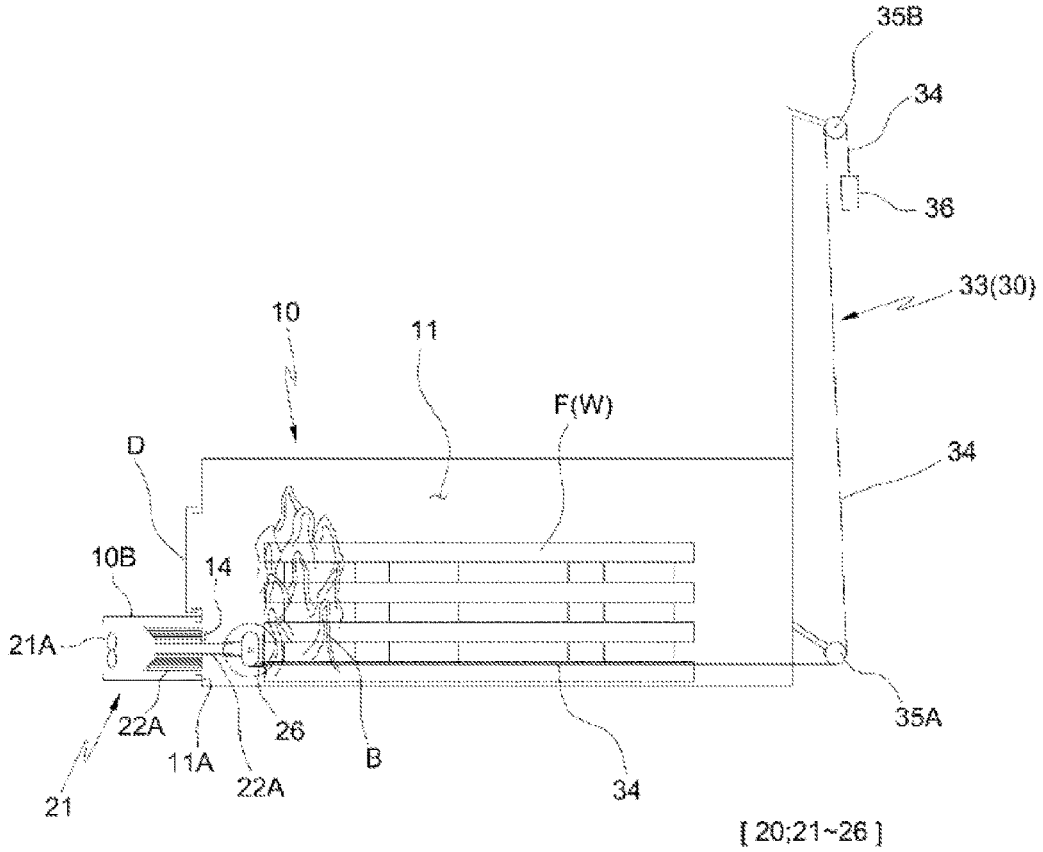
Figure 6:
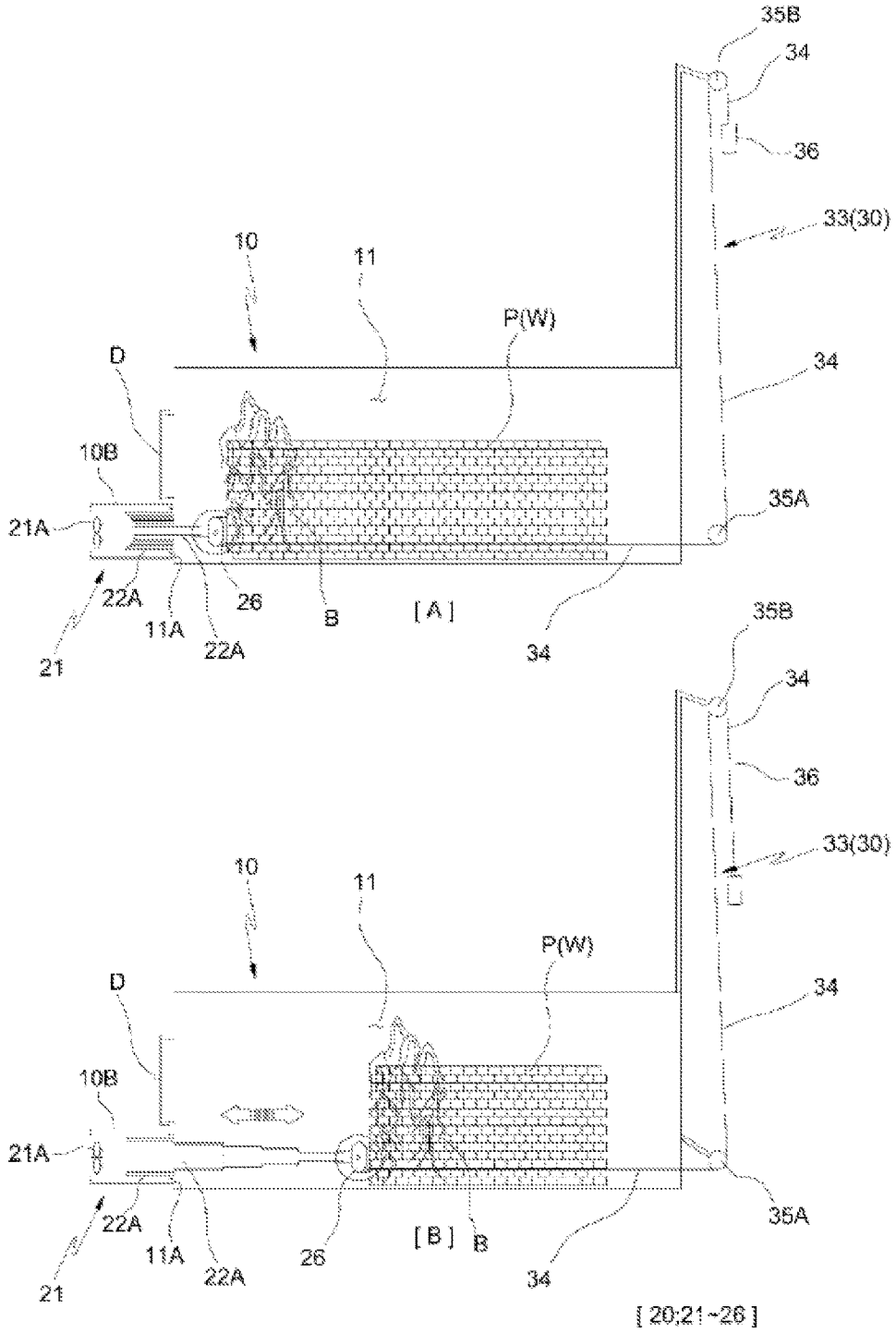

Next, FIGS. 4 to 6 are views illustrating an operating unit 30 according to a second embodiment, an air supply pipe 22A is formed as a telescopic type, the operating unit 30 is provided as a towing part 33 configured to force the nozzle 26 to be towed toward one side of the wood fuel W, and accordingly, the gap between the nozzle 26 and the wood fuel W is maintained constantly.

More specifically, an auxiliary housing 10B, in which parts of the telescopic type air supply pipe 22A are accommodated, is provided at one side (the left side in the drawings) of the housing 10, an entrance and exit port 14, in which the nozzle 26 is disposed and moves in and out therethrough, is formed at the left panel 11A at which the housing 10 and the auxiliary housing 10B are coupled, and since the nozzle 26 is forced to move toward one side of the wood fuel W while being towed by the towing part 33 and the gap-maintaining member 27 comes into contact with one side (the combustion region B) of the wood fuel W, the gap between the nozzle 26 and the wood fuel W is maintained constantly.

The air supply part 21 provided with the fan 21A and the damper (not shown) is installed at the auxiliary housing 10B, and air is supplied to the telescopic type air supply pipe 22A and the nozzle 26 and sprayed.

In addition, the towing part 33 is provided with a wire 34 including one end connected to the nozzle 26 or the gap-maintaining member 27, a first roller 35A installed at another side of the housing 10 and configured to guide the other end of the wire 34 upward, a second roller 35B which is installed above the housing 10 and at which the other end of the wire 34 is hung, and a weight 36 fixed to the other end of the wire 34 and configured to tow the wire 34 with a weight thereof.

Accordingly, when one side of wood fuel W is burned, by-products thereof fall, and a position of the combustion region B is changed, the nozzle 26 is towed a length of the change toward the one side of the wood fuel W due to the weight of the weight 36, and since the length thereof is increased as the parts of the telescopic type air supply pipe 22A are accordingly separated from each other, the gap between the nozzle 26 and the wood fuel W may be maintained constantly.

Here, a length (that is, a height when the weight 36 is formed initially) of a support in which the second roller 35B is installed preferably is a length that the nozzle 26 moves forward, that is, the same as a final length of the air supply pipe 22, and since a forward thrust force of the nozzle 26 is determined according to the weight of the weight 36, the weight 36 is preferably detachably formed at the other end of the wire 34, replaced according to the kind of wood fuel W, and used. Since weight adjustment of the weight 36 is sufficiently predicted and reproduced by those skilled in the art, a detailed description thereof will be omitted.

In addition, in the present invention, the wire 34 is formed of a tensible material, and a motor (not shown) which adjusts a degree of tension of the wire 34 is employed instead of the weight 36 so that a tension length of the wire 34 may be adjusted to tow the nozzle 26 by the motor according to the position change of the combustion region B.

Meanwhile, according to the second embodiment of the present invention, since the nozzle 26 is moved forward by the wire 34, wheels 28 which come into contact with a bottom surface of the combustion chamber 11 and help the nozzle 26 to be moved forward may also be provided in the nozzle 26.

As illustrated in the drawings, the wheels 28 may be provided at both side ends of the nozzle 26 and may also be additionally installed under the nozzle 26, and in some cases in which a guiding part (for example, a guide rail to which a nozzle is coupled in a sliding manner) is employed between the nozzle 26 and the bottom of the combustion chamber 11, the wheels 28 may be omitted.

In addition, when the wheels 28 are provided at both of the side ends of the nozzle 26 and a diameter of the wheels is greater than a front-rear width of the nozzle 26, spray holes 26*a* of the nozzle 26 are formed to be spaced a predetermined distance from the wood fuel W by the wheels 28, and the wheels 28 accordingly function as the gap-maintaining member 27 in this case, and protruding pieces 27A (see FIG. 7) may be additionally provided therein.

In addition, in the present invention, a locking part which restricts a position change of the nozzle 26 may be employed to prevent the operating unit 30 from operating during an input operation of the wood fuel W in the first and second embodiments.

Hereinafter, a locking part according to the first embodiment installed at the shaft coupling portion 25 will be generally described, employment of the locking part is applied to the second embodiment in the same manner, and since such a structure is similar in the first and second embodiments, those skilled in the art may modify, replace, change, and reproduce the locking part for the first and second rollers 35A and 35B, the telescopic type air supply pipe 22A, or the like, and thus a detailed description thereof related to the second embodiment will be omitted.

As illustrated in FIG. 1, the locking part is provided with a fixing handle 37 which restricts rotation of the first swing rod 32*a*, the second swing rod 32*b*, or the air supply pipe 22.

The fixing handle 37 is screw-coupled to one side of the shaft coupling portion 25 in the auxiliary housing 10A, restricts the rotation of the swing rods 32*a* and 32*b* or the air supply pipe 22 when coupled thereto, and releases the restriction of rotation when separated therefrom.

Accordingly, when the wood fuel W is input to the combustion chamber 11, a user adjusts the nozzle 26 to be positioned at an initial position, couples the fixing handle 37 to the one side of the shaft coupling portion 25, and restricts the rotation of the air supply pipe 22, and when the wood fuel W are completely input, the user separates the fixing handle 37 therefrom to operate the operating unit 30.

In addition, since the position change of the nozzle 26 is restricted by the locking part and the wood fuel W and, particularly, the firewood fuel F, is frequently input to be burned, atmosphere of an outdoor activity can be improved.

That is, after the nozzle 26 is fixed at a predetermined position in the combustion chamber 11 by the locking part, a small amount of firewood fuel F is input to a position at which the nozzle 26 is fixed in the combustion chamber, a combustion region is formed at only a predetermined position, and since the firewood fuel is repeatedly input like a conventional stove or fire pot, there is an effect in that the combustion apparatus can be operated while enjoying atmosphere of an old-fashioned way.

Next, since it is preferable that the nozzle 26 have the spray holes of which a form, a size, a length, an angle, a gap, and the like are changed according to the kind of wood fuel W to be used, it is preferable that the nozzle 26 be detachably coupled to a head 24 of the air supply pipe 22 as illustrated in FIG. 7.

That is, in the case of the firewood fuel F, the spray holes 26*a* are preferably formed to be long at a wide angle to reduce a pressure (or speed) of sprayed air to prevent a flame from being distinguished by the sprayed air, the spray holes 26*a* are preferably formed to be long and narrow in a downward direction to raise a spraying pressure so that air sufficiently reaches an inside of the pellet fuel in the case of the pellet fuel P, and accordingly a coupling part 24A is employed at the nozzle 26 to selectively use the nozzle 26 according to the wood fuel W to be used.

The coupling part 24A may be provided with a coupling method of a button, a fixing pin, or the like, and although the nozzle 26 is typically illustrated as being detached therefrom by the fixing pin 24*a* in the drawings, since various coupling parts 24A including the fixing pin 24*a* are known technology, a detailed description will be omitted.

Meanwhile, the nozzle 26 includes a plurality of air spray holes 26*a* to improve an efficiency of air spraying, and the gap-maintaining member 27 is provided with a plurality of protruding pieces 27A protruding forward along perimeters of the air spray holes 26*a*.

Here, a concept in which the protruding pieces 27A are provided along the perimeters of the spray holes 26*a* includes a concept in which the protruding pieces 27A are provided between the spray holes 26*a* or a concept in which the protruding pieces are provided along an outer side surface of the perimeter of the nozzle 26 as illustrated in the drawings.

Here, although the gap-maintaining member 27 may also be integrally formed with the nozzle 26 to protrude along the outer side surface of a front perimeter thereof (a kind of form in which a mouth protrudes), the gap-maintaining member 27 is preferably provided with the plurality of protruding pieces 27A because a form, a size, a length, an angle, a gap, and the like of the spray holes 26*a* are changed according to the wood fuel W to be used as described above so that the gap-maintaining member 27 does not interfere with the air spraying. In this case, the gap-maintaining member 27 may also be formed to be detachable from a front of the nozzle 26.

In addition, although not illustrated in the drawings, the protruding pieces 27A may also be provided at the nozzle 26 according to the second embodiment, and the wheels 28 also may function as the gap-maintaining member 27 instead of the protruding pieces 27A as described above.

As described above, the combustion apparatus for both firewood and pellet fuel according to the present invention having a specific form and a structure has been described with reference to the accompanying drawings, however, the present invention may be variously modified, changed, and replaced by those skilled in the art, and such a modification, a change, and a replacement should be interpreted as being included in the claims of the present invention.

The invention claimed is:

1. A combustion apparatus for both firewood and pellet fuel comprising:

a combustion chamber in which wood fuel including firewood or a pellet is stacked;

an air supply unit provided with an air supply pipe, a nozzle connected to the air supply pipe, and a gap-maintaining member connected to the nozzle, said nozzle configured to spray air directly toward one of right and left sides of the wood fuel in a side direction thereof; and an operating unit comprising weights configured to use the potential enemy of the weights to change a position of the nozzle according to a position of a region of the wood fuel in which combustion is performed in order to force the gap-maintaining member to come into contact with one side of the wood fuel and to continuously maintain a constant gap between the nozzle and the wood fuel during combustion.

2. The combustion apparatus of claim 1, wherein:

the air supply pipe is installed to swing about a shaft coupling portion at an upper portion of the combustion chamber;

the operating unit is provided as a swing part provided at the shaft coupling portion and configured to force the nozzle provided at an end of the air supply pipe to swing toward the one side of the wood fuel; and the constant gap between the nozzle and the wood fuel is maintained during combustion.

3. The combustion apparatus of claim 1, wherein:

the air supply pipe is formed as a telescopic type;

the operating unit is provided as a towing part configured to force the nozzle to be towed toward the one side of the wood fuel; and the constant gap between the nozzle and the wood fuel is maintained during combustion.

4. The combustion apparatus of claim 1, wherein:

the nozzle includes a plurality of air spray holes; and the gap-maintaining member is provided with a plurality of protruding pieces protruding forward along perimeters of the air spray holes.

* * * * *